US005553641A

United States Patent [19]

Zenoni

[11] Patent Number: 5,553,641

[45] Date of Patent: Sep. 10, 1996

[54] POSITIVE MODULATED BRAKING OF THE THREAD FOR WEFT FEEDERS

[75] Inventor: Pietro Zenoni, Leffe, Italy

[73] Assignee: L.G.L. Electronics S.p.A., Bergamo, Italy

[21] Appl. No.: 537,499

[22] Filed: Oct. 2, 1995

[30] Foreign Application Priority Data

Oct. 10, 1994 [IT] Italy ..... TO94A0805

[51] Int. Cl.[6] ..... D03D 47/34

[52] U.S. Cl. ..... 139/452; 242/47.01

[58] Field of Search ..... 139/452; 242/47.01

[56] References Cited

U.S. PATENT DOCUMENTS

| | | | |
|---|---|---|---|
| 5,316,051 | 5/1994 | Zenoi et al. | 139/452 |
| 5,343,899 | 9/1994 | Jacobsson et al. | 139/452 |
| 5,351,724 | 10/1994 | Zenoni et al. | 139/452 |

FOREIGN PATENT DOCUMENTS

| | | | |
|---|---|---|---|
| 0536088 | 4/1993 | European Pat. Off. | 139/452 |

*Primary Examiner*—Andy Falik
*Attorney, Agent, or Firm*—Guido Modiano; Albert Josif

[57] ABSTRACT

Device for positive modulated braking of weft feeder thread, including a braking body, typically a frustum-shaped braking body, that is supported frontally and coaxially to the drum of the feeder in order to directly or indirectly engage the thread that unwinds from the drum. The braking body is subjected to the action of an electromechanical actuator, supplied by an excitation current that is modulated so as to match the variation in the mechanical tension of the thread during the weaving process; the braking body is rigidly coupled to a support that is movable in the axial direction of the drum of the feeder and is supported and guided by a fixed support. The movable support is subjected to the action of a reversible motor that is supported by the fixed support, is supplied with the modulated excitation current, and is connected to the movable support with the interposition of a mechanical coupling capable of converting the angular movements of the shaft of the motor into corresponding translatory motions of the movable support with respect to the fixed support.

14 Claims, 3 Drawing Sheets

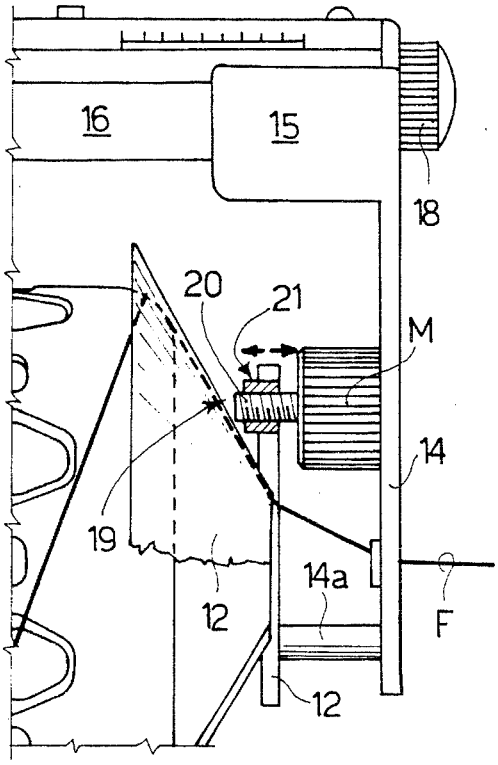
FIG.2
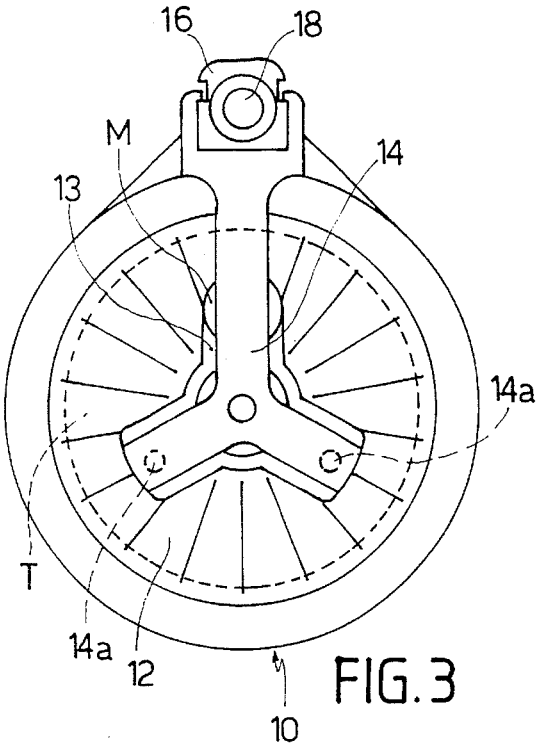
FIG.3
FIG.4
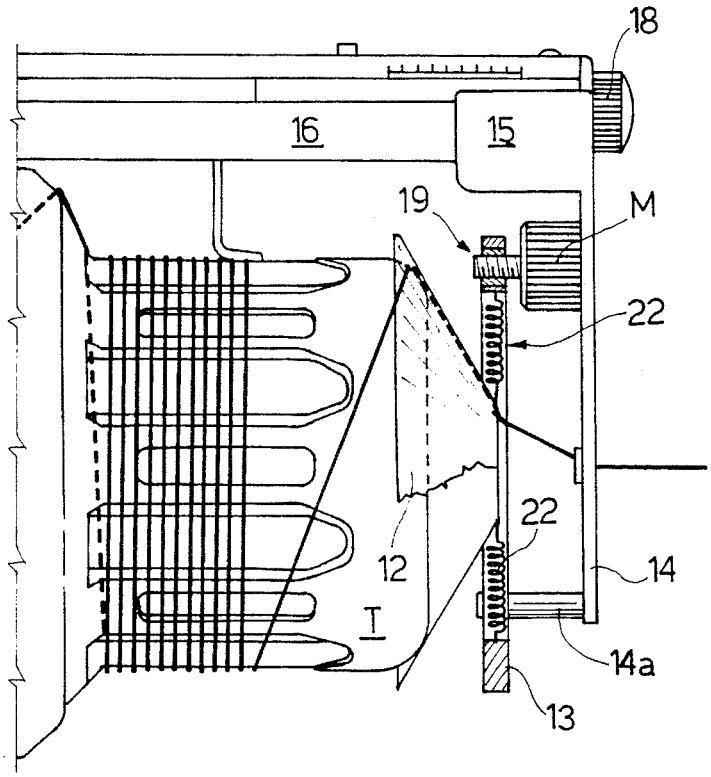

POSITIVE MODULATED BRAKING OF THE THREAD FOR WEFT FEEDERS

BACKGROUND OF THE INVENTION

The present invention relates to a device for the positive modulated braking of the thread for weft feeders of shuttleless looms, particularly gripper looms, projectile looms, and air-jet looms.

In the present description, the term "positive" relates to the modulated braking of the thread produced by the action applied to the braking means by an electric excitation or pick-up current that is modulated so as to match the variations in the mechanical tension of the thread during the weaving process.

More specifically, the present invention relates to a device for the positive modulated braking of the thread, that comprises a braking means having a continuous circular shape, typically a frustum-shaped body, which is supported frontally and coaxially to the drum of the feeder in order to engage, either directly or with the interposition of resilient elements, the thread that unwinds from said drum, and in which the frustum-shaped braking body is subjected to the action of an electromechanical actuation means capable of varying the pressure with which said body makes contact with the drum of the feeder, said actuation means being supplied with said modulated excitation current.

In conventional devices for positive modulated braking the braking body is subjected to the electrodynamic action produced by the interaction of the excitation current that flows in a moving coil associated with the braking body and the magnetic field of a permanent magnet that is fixed with respect to said braking body.

A device of the above-mentioned type, hereinafter referred to as a "conventional device", is disclosed for example in published European patent application No. 536,088.

Although both of these conventional devices achieve effective modulated braking, they have structural and functional drawbacks. From a structural point of view, they are relatively complicated and bulky and require accurate manufacture of the moving coils and of the fixed permanent magnet, between which a minimal air gap must be provided in order to achieve a significant electrodynamic action with low excitation currents. On the other hand, the conductor of the moving coils must be small in size and the coils must be formed by a minimal number of turns in order to avoid excessive increases in the mass and therefore in the inertia of the frustum-shaped body that supports said coil; this is the main structural drawback, since it in any case limits the maximum allowable value of the excitation current; accordingly, the electrodynamic action affecting the frustum-shaped body, which depends on the ampere-turns, is in any case limited to small values that are sufficient to produce the modulated thread braking action if the frustum-shaped body acts by direct contact on the drum of the device but are substantially insufficient if said body acts on the thread with the interposition of flexible elements, such as rows of flexible laminae or rings of bristles.

SUMMARY OF THE INVENTION

A principal aim of the present invention is to eliminate the above-mentioned drawbacks and, within the scope of this aim, it has the following important particular objects:

to provide a device for the positive modulated braking of the thread having an extremely simplified structure, in which the positive braking body, which is typically frustum-shaped, is subjected to the action of an actuation means capable of applying, under the control of said excitation current, a mechanical force of substantially significant intensity that is in any case adapted to actuate said body even if it applies the action not directly but with the interposition of flexible elements;

to provide a modulated braking device in which the braking body has minimal mass and therefore minimal inertia by virtue of the elimination of the electrodynamic interaction coils associated therewith, said body being therefore capable of following, without appreciable delays, the modulation of the excitation current that supplies the positive actuation means of said frustum-shaped body;

to provide a modulated braking device that has minimum bulk, is extremely sensitive and highly reliable in operation.

According to the present invention, this aim and other important objects are achieved with a positive modulated braking device having the specific features disclosed in the appended claims.

Substantially, the invention is based on the concept of rigidly coupling the braking body, which is typically a frustum-shaped body, to a movable support that is supported and guided by a fixed support, and of subjecting the movable support to the action of a reversible motor, preferably a step motor. The motor is supplied with an excitation current that is modulated in proportion to the variations in the mechanical tension of the thread, and acts on said movable support of the braking body with the interposition of a mechanical coupling system capable of converting the angular movements of the motor shaft into corresponding translatory motions of the movable support with respect to the fixed support.

The fixed support is in turn supported by a movable slider, which is slideable on a supporting structure parallel to the axis of the drum of the feeder, and is controlled by an adjustment knob allowing to vary the tension applied by the braking body to the thread in static conditions.

Preferably, the shaft of the step motor is coupled to the movable support of the braking body by means of a coupling comprising a screw and a ball bearing nut.

BRIEF DESCRIPTION OF THE DRAWINGS

The characteristics, purposes, and advantages of the modulated braking device according to the present invention will become apparent from the following detailed description and with reference to the accompanying drawings, given by way of non-limitative example, wherein:

FIG. 2 is an enlarged-scale view of a detail of FIG. 1;

FIG. 3 is a partial front view of the device, taken along the direction of the arrows II—II of 1;

FIG. 4 is a view of a further embodiment of the device of FIG. 1;

DESCRIPTION OF THE PREFERRED EMBODIMENTS

Figure 1:
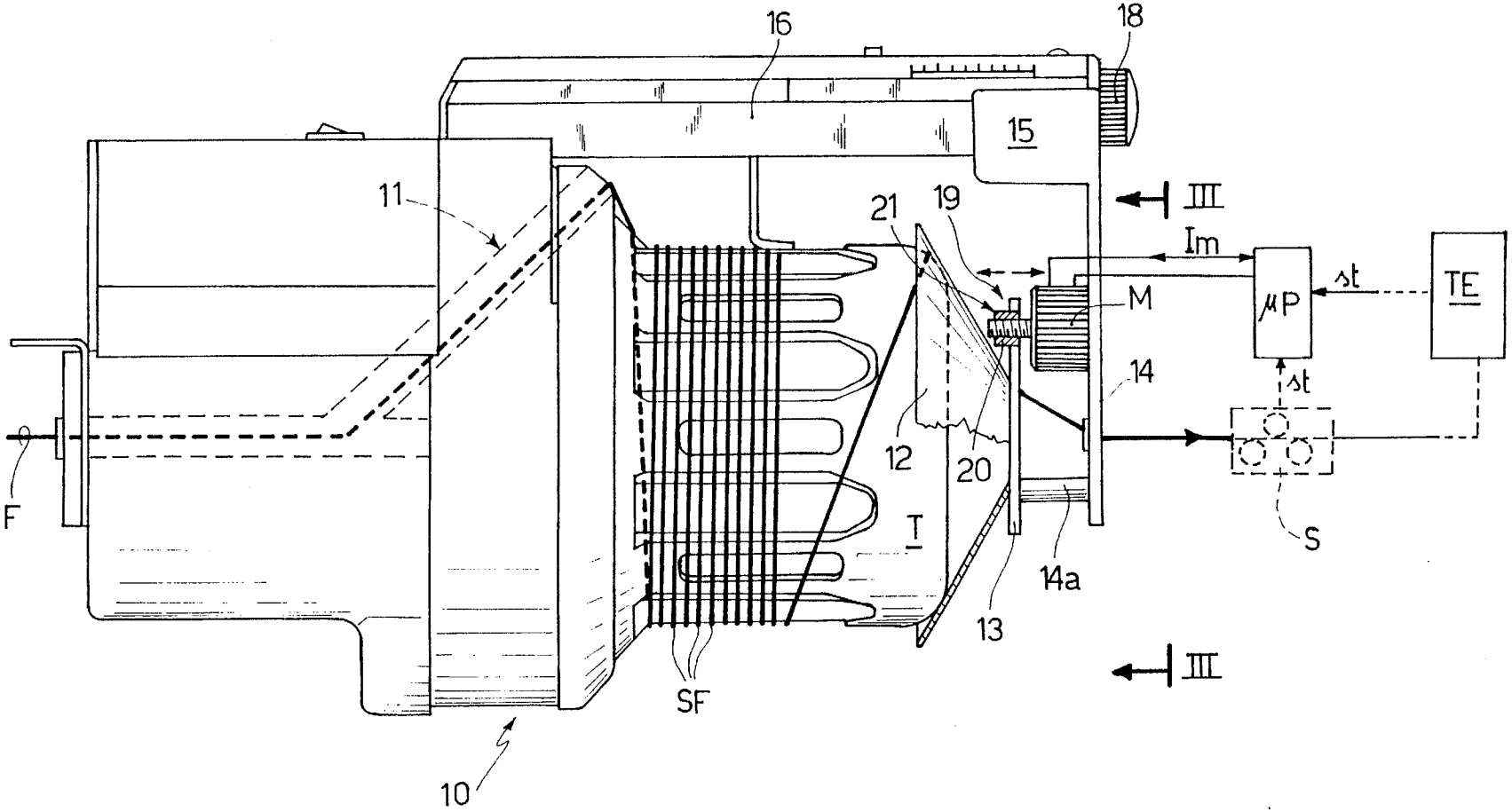
FIG. 1 is a schematic partially sectional lateral elevation view of a weft feeder with the modulated braking device according to the invention, in the embodiment comprising a modulated braking body that acts directly on the thread.

With reference to FIGS. 1 to 3, the reference numeral 10 designates a conventional weft feeder comprising a fixed drum T on which a hollow rotating arm 11, or windmilling arm, winds a plurality of turns SF that constitute a reserve of weft. The hollow arm is rigidly coupled to an equally hollow driving shaft, and the thread F coming from the spool, not shown, runs in the cavities of the shaft and of the arm. At each beat, the loom TE draws a certain number of turns from the reserve SF, and the thread that unwinds from the drum T of the feeder 10 is affected by a positive modulated braking means that controls the mechanical tension of the thread, keeping it substantially constant when variations occur in the sliding acceleration that the loom TE applies to said thread in performing each individual beat.

The braking means is constituted by a braking body 12, which is typically a frustum-shaped body having a continuous circular shape, is made of high-strength synthetic material, and is supported by a movable support 13 formed by three arms arranged at 120° frontally and coaxially to the drum T of the feeder 10, against which said body 12 is pushed into contact to engage the thread F.

According to the present invention, the movable support 13 is supported, so as to be axially movable, by a fixed support 14, also having three arms; for this purpose, the support 13 is slideable on two guiding and retention pivots 14*a* that are preferably cylindrical and are rigidly coupled to the fixed support 14 or vice-versa.

Said fixed support, in turn, is supported by a slider 15 that is slideable on guides of a fixed structure 16 running parallel to the drum T of the feeder 10. A screw system, which is per se known and not shown, allows to move, by means of a knob 18, the slider 15 and the support 14 therewith, in order to set the force with which the body 12 presses on the drum T in static conditions, that is to say, when the thread is not running.

A motor M of the reversible type, preferably a step motor, is arranged on the fixed support 14 and is adapted to act on the movable support 13 in order to modulate, proportionally to the variation in the mechanical tension of the thread during the beat of the loom, said pressure applied by the body 12 to the drum T. For this purpose, a mechanical coupling, designated by the reference numeral 19, is interposed between the motor M and the movable support 13 and is capable of converting the angular movements of the shaft of the motor M into corresponding axial movements of the movable support 13 with respect to the fixed support 14.

Preferably, the coupling 19 is constituted by a screw 20 associated with the shaft of the motor M and meshes with a threaded ball bearing nut 21 rigidly coupled to the movable support 13. The motor M is powered so as to move in very small steps and in opposite directions with an excitation current $I_m$ that is modulated in intensity and direction and is produced for example by a microprocessor μP, which receives from the loom TE, or as an alternative from a sensor S, a signal "st" for modulation of the current $I_m$ that is proportional to the momentary value of the tension of the thread F.

In the further embodiment of FIG. 4, the frustum-shaped body 12 is rigidly coupled to the movable support 13 with the interposition of springs 22 that provide an elastic suspension capable of damping the braking action but most of all of ensuring perfect centering of the frustum-shaped body 12 with respect to the drum of the feeder 10.

Figure 5:
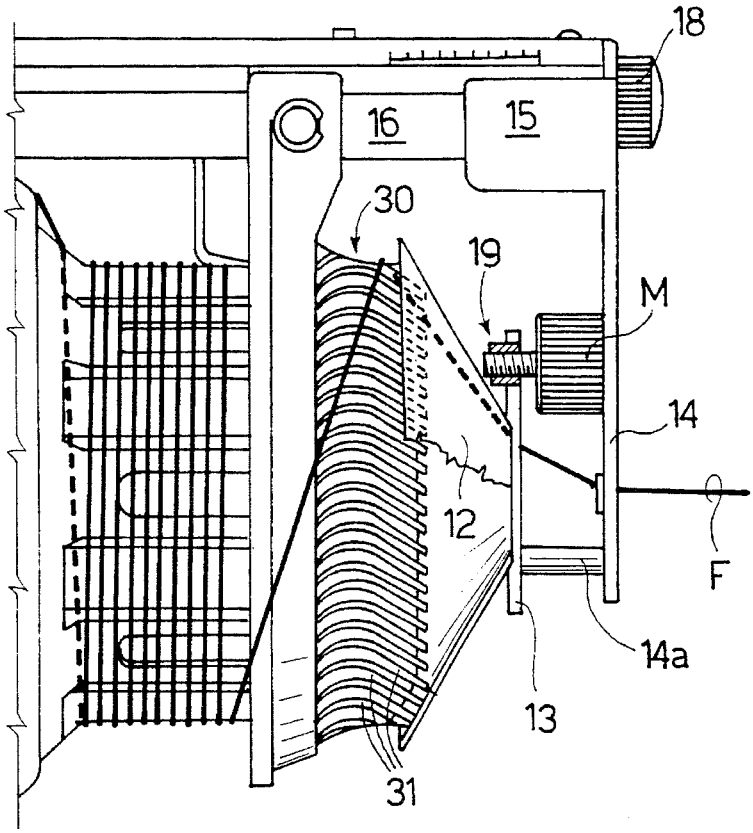
FIG. 5 is a partial view, similar to FIG. 1, of another embodiment of the device, in which the braking body acts on rows of braking laminae.

The embodiment of FIG. 5 instead differs from the embodiment of FIG. 1 in that the frustum-shaped body 12, instead of acting directly on the drum T of the feeder 10, acts on the front ends of a paraboloidal row 30 of elastic metallic laminae 31 which, in a per se known manner, adhere elastically to the cylindrical surface of the drum in order to brake the unwinding of the thread F. The modulated movement of the body 12 on the front ends of said paraboloidal row 30 changes the end circumference of the paraboloid and accordingly varies the contact pressure of the laminae 31 on the drum T, correspondingly modulating the braking action applied by said laminae on the thread F.

Figure 6:
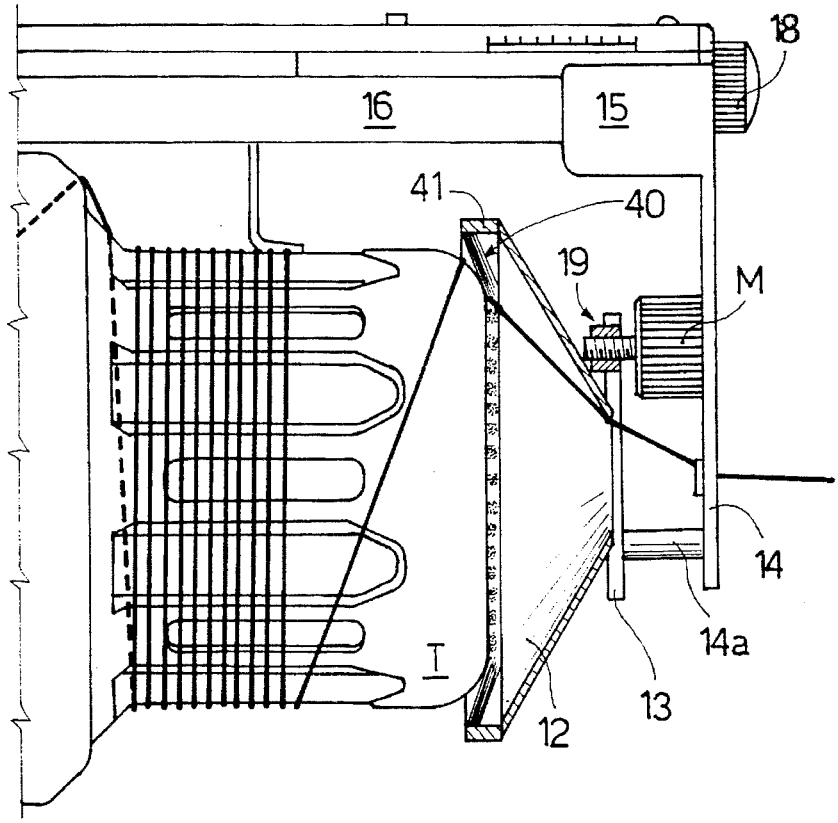
FIG. 6 is a partial view, similar to FIG. 1, of a further embodiment of the device, in which the braking body acts on a braking ring of the type with bristles.

In the embodiment of FIG. 6, the frustum-shaped body 12 is used to modulate the braking action of a ring of bristles 40 that frontally engage, in a per se known manner, the drum T of the feeder 10. For this purpose, the wider end of the frustum-shaped body 12 ends with a ring 41 internally provided with said ring of bristles 40.

Of course, without altering the concept of the invention, the details of the execution and the embodiments may be varied extensively with respect to what has been described and illustrated by way of non limitative example, without thereby abandoning the scope of the invention defined by the appended claims.

What is claimed is:

1. A device for positive modulated braking of a thread in a weft feeder, the device comprising:

a braking means including a frustum-shaped braking body supportable frontally and coaxially to a drum of the weft feeder for directly and indirectly engaging the thread unwinding from said drum;

a fixed support connectable to the weft feeder;

a movable support movably supported and guided on said fixed support, and said frustum-shaped body being rigidly coupled to said movably support such that said frustum-shaped body is movable in an axial direction of the drum of the weft feeder;

an electromechanical actuation means for moving said frustum-shaped body in the axial direction, said actuation means comprising: means for supplying a modulated excitation current that is modulated so as to match a variation in mechanical tension of the thread during a weaving process; a reversible motor supported by said fixed support and being supplied with said modulated excitation current; and a mechanical coupling between said motor and said movable support for converting angular movements of a shaft of the motor into corresponding translatory motions of the movable support with respect to the fixed support so as to move said frustum-shaped body in the axial direction.

2. Device according to claim 1, wherein said motor is a step motor.

3. Device according to claim 1, wherein said movable support and said fixed support are each formed by three arms mutually arranged at 120°, said movable support being slideable on two cylindrical guiding and retention pivots rigidly coupled to said fixed support.

4. Device according to claim 1, wherein said mechanical coupling interposed between the motor and the movable support comprises a screw, said screw being associated with the motor shaft and meshing with a threaded ball bearing nut rigidly coupled to the movable support.

5. Device according to claim 1, wherein said means for supplying a modulated excitation current comprises a microprocessor, said microprocessor receiving from a selected one of a loom and a sensor, a signal, said signal being adapted to modulate intensity and direction of the excitation current proportionally to a momentary value of a tension of the thread.

6. Device according to claim 1, wherein said frustum-shaped body has a continuous circular shape and is made of high-strength synthetic material.

7. Device according to claim 6, wherein said frustum-shaped body is adapted for acting on the drum of the feeder by direct contact engagement with said drum.

8. Device according to claim 6, wherein the frustum-shaped body is rigidly coupled to the movable support with interposition of springs, said springs providing an elastic suspension for said frustum-shaped body.

9. Device according to claim 6, wherein said frustum-shaped body is adapted for acting on front ends of a paraboloidal row of elastic metallic laminae adapted for adhering elastically to the drum of the feeder such that the modulated movement of the frustum-shaped body varies an end circumference of said paraboloidal row and accordingly varies a contact pressure of the laminae against the drum in order to correspondingly modulate a braking action of said laminae on the thread.

10. Device according to claim 6, wherein the frustum-shaped body is provided, at a wider end thereof, with a ring, said ring being internally provided with a ring of bristles for frontally engaging the drum of said feeder to provide modulated braking of the thread.

11. Device according to claim 1, wherein said fixed support is supported by a slider, said slider being slideable on guides of a fixed structure that is arrangeable to extend parallel to the drum of said feeder, said slider being controlled by a screw-operated movement system that allows, by means of a knob connected thereto, to move the support, and the braking means together with said support, in order to set a tension with which said braking means act on said drum in static conditions, when the thread is not running.

12. A device for positive modulated braking of a thread in a weft feeder, the device comprising:

a frustum-shaped braking body which is movably supportable frontally and coaxially to a drum of a weft feeder for engaging a thread unwinding from the drum;

a supporting structure for movably supporting said braking body substantially in an axial direction of the drum of the weft feeder;

a reversible motor including an output shaft;

a device for supplying a modulated excitation current to the reversible motor, which modulated excitation current is modulated so as to match a variation in mechanical tension of the thread unwinding from the drum; and a mechanical coupling between said motor and said supporting structure for converting angular movements of said output shaft of said motor into corresponding translatory motions of said frustum-shaped body in the axial direction.

13. The device of claim 12 wherein said supporting structure includes a support rigidly connected with said braking body and said mechanical coupling includes a threaded screw and nut assembly interconnected between said output shaft of said motor and said support.

14. A device for positive modulated braking of a thread in a weft feeder, the device comprising:

a braking body means which is movably supportable frontally and coaxially to a drum of a weft feeder for engaging a thread unwinding from the drum;

a supporting means for movably supporting said braking body means substantially in an axial direction of the drum of the weft feeder;

a reversible motor means including an output shaft for moving said braking body means in the axial direction;

means for supplying a modulated excitation current to the motor means, which modulated excitation current is modulated so as to match a variation in mechanical tension of the thread unwinding from the drum; and means for mechanical coupling said motor means with said supporting means so as to convert angular movements of said output shaft of said motor means into corresponding translatory motions of said braking body means in the axial direction.

* * * * *